US006765179B2

(12) United States Patent
Wilde et al.

(10) Patent No.: US 6,765,179 B2
(45) Date of Patent: Jul. 20, 2004

(54) ELECTRIC RADIANT ELEMENT WITH AN ACTIVE SENSOR FOR COOKING VESSEL DETECTION

(75) Inventors: Eugen Wilde, Maulbronn (DE); Erich John, Pforzheim (DE); Wilfried Schilling, Kraichtal (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 77 days.

(21) Appl. No.: 10/191,160

(22) Filed: Jul. 9, 2002

(65) Prior Publication Data

US 2003/0010769 A1 Jan. 16, 2003

(30) Foreign Application Priority Data

Jul. 13, 2001 (DE) ..... 101 35 270

(51) Int. Cl.[7] ..... H05B 3/68

(52) U.S. Cl. ..... 219/448.19; 219/447.1; 219/518

(58) Field of Search ..... 219/443.1, 445.1, 219/446.1, 447.1, 448.11, 460.1, 509, 518, 448.13, 448.19, 462.1

(56) References Cited

U.S. PATENT DOCUMENTS

| | | | | | |
|---|---|---|---|---|---|
| 4,334,135 | A | * | 6/1982 | Smith | 219/626 |
| 5,424,512 | A | * | 6/1995 | Turetta et al. | 219/447.1 |
| 5,893,996 | A | * | 4/1999 | Gross et al. | 219/447.1 |
| 5,900,174 | A | * | 5/1999 | Scott | 219/447.1 |
| 6,242,721 | B1 | * | 6/2001 | Borrmann et al. | 219/518 |
| 6,552,307 | B2 | * | 4/2003 | Schilling et al. | 219/448.11 |

FOREIGN PATENT DOCUMENTS

| | | |
|---|---|---|
| DE | 196 03 845 A1 | 8/1997 |
| EP | 0 553 425 A1 | 8/1993 |

* cited by examiner

*Primary Examiner*—Sang Paik
(74) *Attorney, Agent, or Firm*—Greenberg Traurig

(57) ABSTRACT

An electric radiant heater (11, 111) is provided having an active sensor (21, 121) for detecting the position of a cooking vessel on a glass ceramic plate over the radiant heater (11, 111). The sensor (21, 121) is mad from electrically conductive material and is part of an inductive resonant circuit of a control operating by resonant circuit detuning. It also covers a heating zone (17, 117) of the radiant heater (11, 111). The sensor (21, 121) runs substantially linearly and, unlike conventional sensor coils, has a loopless construction. It is e.g. possible to stretch a wire (121) or also to use the tube (21) of a rod regulator.

21 Claims, 2 Drawing Sheets

ELECTRIC RADIANT ELEMENT WITH AN ACTIVE SENSOR FOR COOKING VESSEL DETECTION

BACKGROUND OF THE DISCLOSURE

1. Field of the Invention

The invention relates to an electric radiant heater with an active sensor for detecting the positioning of a cooking vessel or pot on a hotplate covering the radiant heater.

2. Background Art

Such sensors, known e.g. from DE 196 03 845 A1, are used for detecting whether and possibly where a cooking vessel is standing on the hotplate. The heating system is only activated when the cooking vessel is located thereon. This takes place on the one hand to avoid the wasting of energy when there are no cooking vessels on the hotplate and on the other prevents any danger of burning or destruction of articles by hot, open-running hotplates.

The sensor according to DE 196 03 845 A1 is constructed as a wire loop, which runs in a substantially round form between the heater and the hotplate. The setting down of a corresponding metallic cooking vessel brings about a change to the inductance of the sensor loop. This change is detected by an associated electronic means as the setting down of a cooking vessel. In the intended manner, the heating system can be activated independently thereof. Difficulties arise through the fitting of the sensor to the radiant heater. Problems also occur with the sensor weight, particularly in a falling weight test, in which the sensor can e.g. damage a glass ceramic plate as the cooking area.

SUMMARY OF THE INVENTION

The problem of the invention is to provide an aforementioned electric radiant heater in which the fitting of the sensor to the radiant heater is simplified and the latter has an improved construction.

This problem is solved by a radiant heater having an active sensor for detecting the position of a cooking vessel on a hotplate, for example a glass ceramic plate, in which the radiant heater is located in at least one heating zone and is connected to a control. The control comprises an inductive resonant circuit, wherein the hotplate covers the radiant heater. The sensor comprises electrically conductive material, is part of said inductive resonant circuit of aid control, is located in the vicinity of said heating zone and at least partly covers said heating zone. The sensor runs in a substantially linear manner and is constructed loopless. Advantageous developments of the invention appear in the subclaims and are described in greater detail hereinafter. By express reference the wording of the claims is made into part of the content of the present description. In the application, the word "comprise" means "including" and is not limited to the meaning of "consisting".

Unlike in the known, conventional circular sensor loops or coils, the sensor according to the invention is constructed in loopless manner. It runs substantially linearly and preferably at least in essential parts of its path. Particular preference is given to it running substantially exclusively linearly in the vicinity of the radiant heater or the heating zone. In conjunction with the present invention loopless means that the sensor does not form a complete or a largely closed loop. In its path the sensor preferably bounds no surface.

The expression "substantially linear" also means a not excessively undulating or similarly constructed sensor.

Finally, it passes in a single direction or its path can be described thereby.

A sensor according to the invention has the advantage that the construction can be considerably simplified. A complete, circumferential loop, which in certain circumstances can also have several turns, is not fitted to the radiant heater and instead this only applies to straight portions thereof. They can e.g. be fixed with at least one end to the edge of the radiant heater or an insulation surrounding the latter. Loop-like sensors also suffer from the disadvantage that the central zone of the radiant heater cannot be precisely established, because it is not directly traversed by the sensors. Due to the circumferential, looplike character thereof no portion can pass through this central area. However, no problem arises in guiding a straight sensor over said central area.

It has surprisingly proved possible with the invention, e.g. with two wires stretched in parallel over a multicircuit heater to detect both the setting down of a cooking vessel and also its size and even its position.

It also surprisingly been found that the sensor need only have a portion running over the heating zone, e.g. constructed as a straight, electric conductor. It can extend from one edge of the radiant heater to beyond its centre and preferably up to the other edge, such a sensor enclosing no surface. Surprisingly the function or detection precision is just as good as with the above-described, parallel conductors as sensors. As a function of the set switching threshold of an associated electronic system, it is possible to decide whether a cooking vessel has been set down or whether the cooking vessel or position is accepted.

Advantageously the sensor runs transversely over a heating zone or the entire radiant heater. It is advantageously possible, particularly with a sensor having a single conductor or portion, to use radiant heaters provided with a metal plate or disk substantially carrying or containing the radiant heater. The metal disk can be constructed as a return conductor or as a second connection for the sensor. This obviates the need for complicated, additional connection work. It has surprisingly been found that this does not impair the function of such a cooking vessel detection sensor. At at least one of its end regions, the sensor can be electrically insulated from the metal disk of the radiant heater. By said insulated end region, it is connected to a first electrical connection accessible from the outside. The other sensor end is directly or indirectly connected to the metal disk. In a particularly simple construction it is only necessary to fasten a second electrical connection at a random point of the metal disk in order to be electrically connected thereto.

According to a particularly preferred development, a connection possibility or a connecting plug for the sensor contains both connections in a connecting member. For this purpose in the vicinity of one sensor end the connection member can be fixed to the radiant heater or the metal disk. When using the metal disk as a return conductor or as a second electrical connection, it is very easily possible to tap the signal at a random point or to place the connection member very close to one sensor end.

Advantageously the sensor passes centrally over the heating area of the radiant heater, which ensures that a cooking vessel placed on the associated hot point covers the sensor in virtually any appropriate position and permits a detection. In the case of a radiant heater with several heating areas, the sensor can pass over more than one heating area and in particular over all the heating areas.

It is also possible for the sensor only to cover separated areas, so that the cooking vessel position is detected for said separated area. This is e.g. advantageous with laterally positioned additional heating means for elongated baking or frying devices or the like.

According to one variant of the present invention, it is possible to fit the sensor to the radiant heater in such a way that when the latter is installed it passes at a limited distance below a hotplate on which the radiant heater is installed. This small distance can be 0.1 to 10 mm and is preferably very small, namely a few 1/10 mm. As a measure for this distance it is also possible to use the upper edge of an insulating plate or the like surrounding the radiant heater and which in the fitted state engages on the underside of the hotplate.

In a further development of the invention, at at least one of the ends of the sensor the latter can have a height adjustment, so that a desired distance or spacing can be precisely set. Such a height adjustment can e.g. have an elongated hole, preferably in a direction perpendicular to the radiant heater plane and located on said radiant heater. The sensor height can be adjusted along this elongated hole.

It is possible to construct the sensor in rigid manner, preferably as a thick wire or in tubular form. For a tubular sensor it is particularly appropriate to use a metal tube, which can be electrically insulated to the outside. In a variant of the invention the sensor can be combined with a rod regulator conventionally used for radiant heaters. The metallic outer tube of the rod regulator can form the sensor or can be used as an electric conductor for the same. This makes it possible to create a combined component requiring much lower installation costs.

Advantageously a conventionally used rod regulator can be fitted with a residual thermal contact on the radiant heater and can be designed as a sensor. If the residual thermal contact of the rod regulator is not required, the space made available in said regulator can be used as a connecting block for the sensor connection.

According to another possibility of the invention the sensor can have an elastic or flexible construction, e.g. in the form of a wire, braid or metal band. The latter can be stretched over at least one portion of the heating area and acquire the necessary stability through the stretching effect.

Within the scope of the invention spring means can be provided for compensating a thermally caused length change of the sensor. Alternatively or additionally the spring means can be used for mounting at least one end of the sensor and/or for maintaining tension and therefore the sensor shape. It must be borne in mind that if the sensor position plays a part, the spring means should be constructed in such a way that they permit a precise, position-defined fastening. The spring tension should be matched to the time/thermal expansion limit of the sensor material or the sensor cross-section. This makes it possible to ensure that the system sensor/spring means has an optimum mutual matching. The spring means is preferably constituted by a leaf spring, which in one variant of the invention can be punched or manufactured from the metal edge of the support disk for the radiant heater.

It is possible to fix or mount at least one end of the sensor on the radiant heater using spring means. The spring means can be electrically insulated against a metal disk for receiving the radiant heater. However, in particularly preferred manner the spring means are used for the electrical binding of the sensor to the metal disk, which is then used as the return conductor or the second electrical connection.

The sensor must have a non-scaling construction, so that it is permanently not attacked or damaged by the high temperatures in the heating zone. It is also advantageous if the sensor material has no Curie point, otherwise there could be falsifications of the measured results.

Additionally it is possible with the above-described, conventionally used rod regulator, to incorporate a precious metal temperature measuring resistor, e.g. in the form of a PT 100 or PT 1000. The precious metal temperature measuring resistor can be interchanged with the ceramic part of the rod regulator. The outer tube of the rod regulator can be constructed as a sensor and as a holder for the precious metal temperature measuring resistor.

Finally, the invention also covers a cooking area with several radiant heaters, in which at least one and preferably all the radiant heaters can be constructed in the above-described manner.

A necessary sensor electronics for evaluating sensor signals should obviously be present and can be constructed as is described e.g. in DE 196 03 845 A1, whose content is by express reference made into part of the content of the present description.

These and further features can be gathered from the claims, description and drawings and the individual features, both singly or in the form of subcombinations, can be implemented in an embodiment of the invention and in other fields and can represent advantageous, independently protectable constructions for which protection is hereby claimed. The subdivision of the application into individual sections and the subheadings in no way limit the general validity of the statement made thereunder.

BRIEF DESCRIPTION OF THE DRAWINGS

Embodiments of the invention are described hereinafter relative to the attached drawings, wherein show.

DETAILED DESCRIPTION OF THE INVENTION

Figure 1:
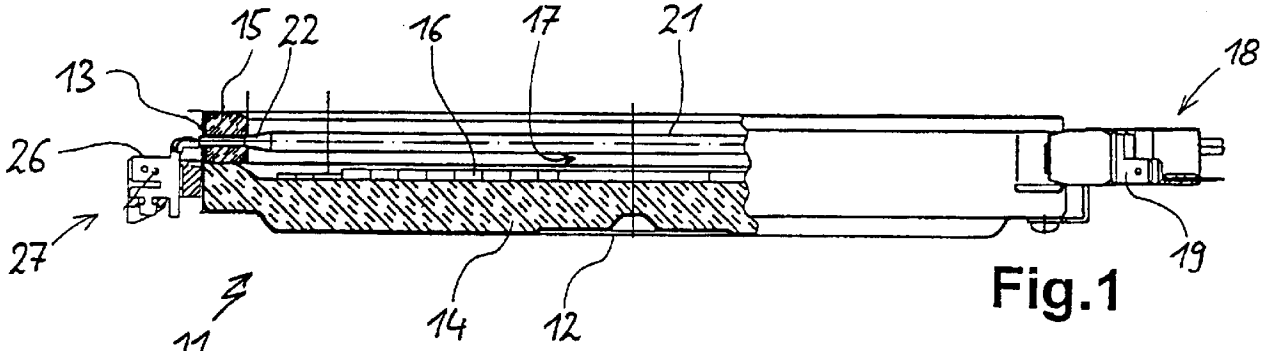
FIG. 1 A cross-section through a radiant heater according to the invention, in which a rod regulator forms the sensor.
Figure 2:
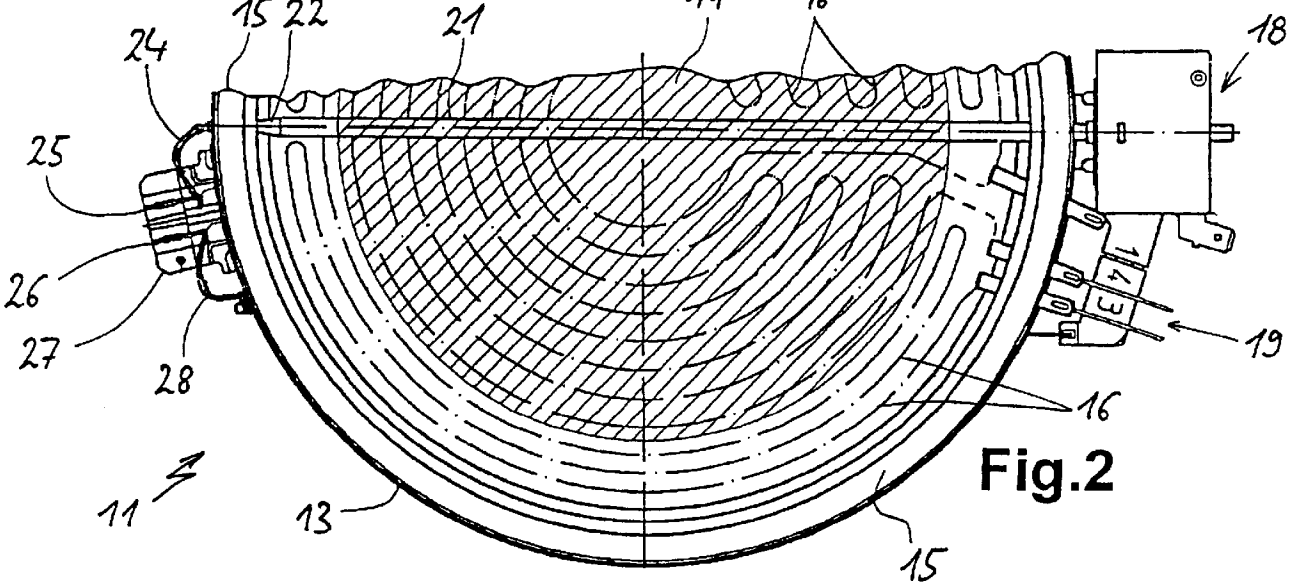
FIG. 2 A plan view of the radiant heater of FIG. 1.

FIGS. 1 and 2 show in cross-section a radiant heater 11 according to the invention and which is essentially constructed in conventional manner. This means that a flat insulator 14 with a circumferential marginal portion 15 is placed in a metal plate or disk 12 with laterally raised edge 13. On the insulator 14 is placed the heating conductor 16 of the radiant heater, e.g. in the form of meander-shaped turns, cf. FIG. 2. A connecting member 18 of a rod regulator is fitted to the metal disk edge 13. Additionally there are further electrical connections 19 for the heating conductor 16 of the radiant heater 11.

The tube 21 of the rod regulator of the connecting member 18 passes transversely over and beyond the entire radiant heater 11 or metal disk 12. By its left-hand end 22 it is mounted in the insulating marginal portion 15 or even projects somewhat above the latter.

According to the invention the metal tube 21 of the rod regulator is constructed as a pot detection sensor. As can be gathered from FIG. 2, the sensor 21 passes over and beyond the entire metal disk 12 or radiant heater 11 and therefore in all cases covers a heating zone 17 formed by the heating conductor 16. The electrical contacting of the tube or sensor 21 takes place in the right-hand area through the sensor either being directly connected to the metal disk 12 or its edge 13 by the fastening of the rod regulator as the earth or ground. As the sensor 21 passes through the metal disk edge 13, it is possible to provide here another electrical contacting possibility, e.g. by simple engagement or corresponding resilient contacting means. The electrical contacting of the other, left-hand end of the sensor 21 takes place on the end 22 which, as can be seen in FIG. 1, extends both through the marginal portion 15 and the metal disk edge 13 and projects somewhat over said edge 13. A piece of flexible metal braid 24 fitted to the end 22 is led to a plugging lug 25 of a connecting member 27. The connecting member 27 is fixed to the metal disk edge 13 and in conventional manner comprises insulating, preferably ceramic material. It is important here that the sensor end 22 has no contact with the metal disk edge 13 in the vicinity of the opening. To this end the opening can be made sufficiently large, because the securing of the position of end 22 takes place by the engaging through the insulating edge 15. A further, even more reliable method is to inwardly insulate the opening or a hole or a cutout with a type of electrically insulating sleeve, e.g. made from a plastic or ceramic material, so that the sensor end 22 can also be mounted on the metal disk edge 13.

The metal disk edge 13 is in turn connected by a further, flexible metal braid 28 to the second plug connecting lug 26 of the connecting member 27. Thus, there is a contacting of the sensor 21 at one end by means of the sensor end 22 and the metal braid 24. At the other end contacting takes place via the metal braid 28 and the disk edge 13. Alternatively to the metal braid 28 the connecting lug 26 could be directly connected to the metal disk 12 or could even be bent out of the latter.

As alternatives to the possibility according to FIGS. 1 and 2, it is conceivable to provide in the vicinity of the connecting member 18 of the rod regulator or sensor 21 a plug connecting lug 26. This would make it possible to do away with the signal line via the metal disk, but this represents no decisive advantage either electrically or functionally. It is very important if there is a single connecting member 27 for both connections 25 and 26 of the sensor 21, so that the assembly or contacting by plugs or the like can take place very easily and in faultless manner. It would also be possible in this case to lead the metal strand or braid 28 from the connecting member 27 to the other end of the sensor 21 in the vicinity of the rod regulator connecting member 18. Although this is possible, it considerably increases costs and is more complicated than the possibility already described.

Moreover, in the construction according to FIGS. 1 and 2, it is possible via the fixing of the rod regulator connecting member 18 and/or via the retaining of the other end 22 of the sensor 21, to fix or adjust the position thereof and therefore the future position below a glass ceramic plate covering the radiant heater 11.

Figure 3:
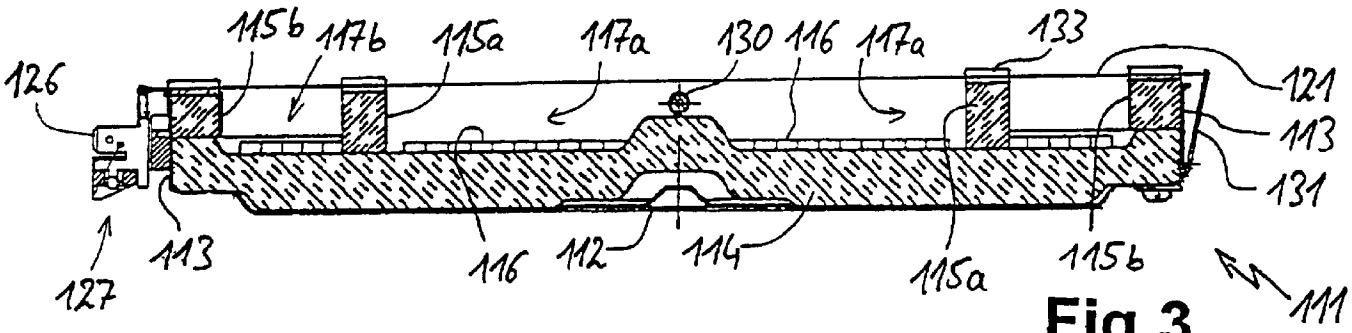
FIG. 3 A cross-section through an alternative construction with a taut wire as the sensor.
Figure 4:
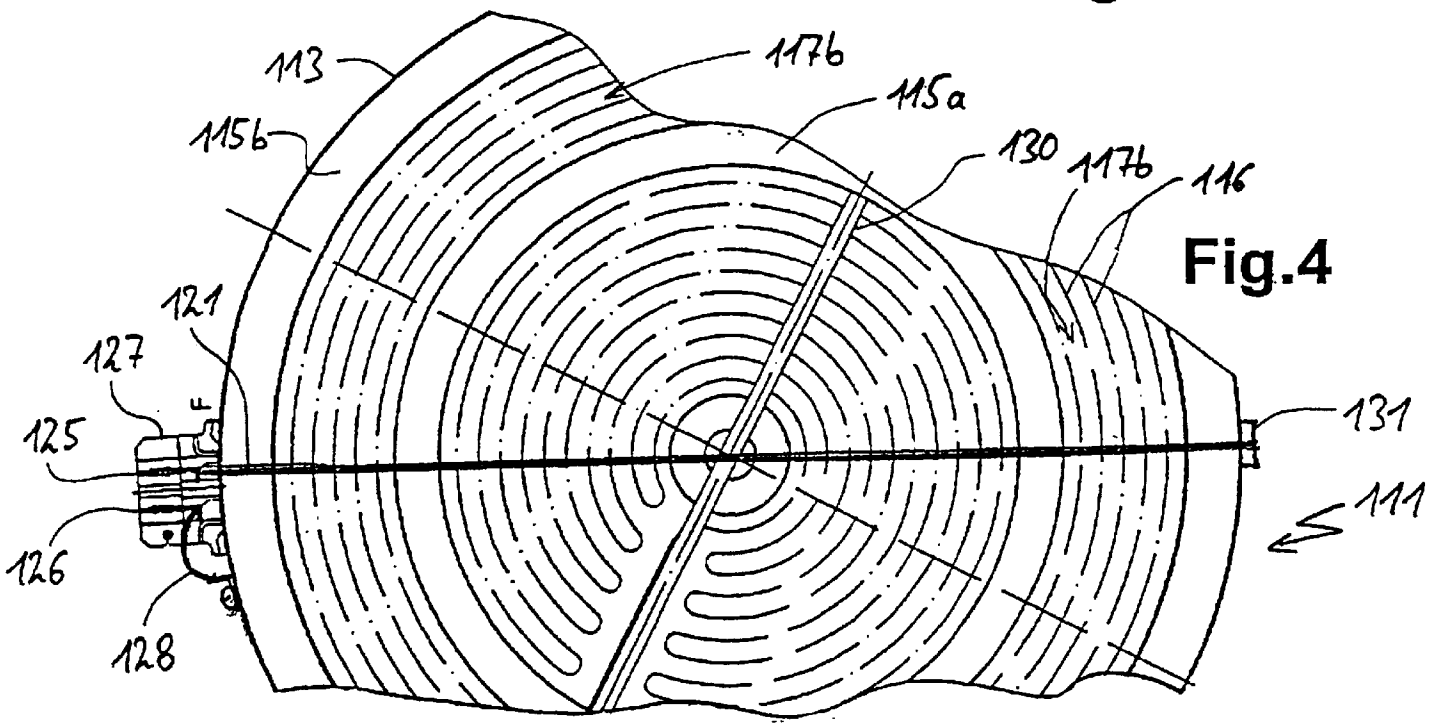
FIG. 4 A plan view of the radiant heater of FIG. 3.

FIGS. 3 and 4 show a similar radiant heater 111 with a metal disk 112, a metal disk edge 113, an insulator 114 and two annular marginal portions 115*a* and 115*b*. The inner marginal portion 115*a* subdivides, via the heating conductors 116, the heating zone into an inner heating zone area 117*a* and an outer heating zone area 117*b*. A rod regulator 130 is represented in detail form in FIG. 4 and corresponds to a conventional rod regulator for preventing excess temperatures, but in this case has no link with the sensor function.

To the right-hand metal disk edge 113 is screwed or riveted a leaf spring 131, whose long, resilient leg projects at an angle of approximately 20Ø from the metal disk edge 113. A sensor wire 121 is fixed to the end of the leaf spring 131 and the fixture is electrically conductive. The sensor wire 121 passes transversely over the radiant heater 111 in each case through corresponding cutouts 133 in the marginal portions 115*a* and 115*b* and covers the heating zone areas 117*a* and 117*b*.

To the left-hand end of the metal disk 112 or its edge 113 is fitted a connecting member 127 corresponding to that in FIGS. 1 and 2. The sensor wire 121 is fitted directly to an upwardly projecting portion of the plug connecting lug 125 in the connecting member 127 in such a way that it is kept straight by the leaf spring 131 as a result of tension. Coinciding with the sensor contacting of FIGS. 1 and 2, the other plug connecting lug 113 is connected by a flexible metal braid 128 to the metal disk edge 113 and therefore via the leaf spring 131 to the sensor 121. Thus, the sensor 121 is contacted in a single connecting member 127 by means of the two plug connecting lugs 125, 126. The advantages of this single connection point and alternatives thereto correspond to those described in conjunction with FIGS. 1 and 2.

A connecting cable can be led from the connecting member 27 or 127 to a corresponding cooking vessel detection electronics, which can be combined with the electronics for controlling the radiant heater or the complete cooking area.

In the construction according to FIGS. 3 and 4 it is possible to make the portion projecting from the connecting lug 126 and to which the sensor wire 121 is fastened, flexible in the direction of the sensor in the manner of a leaf spring or the like. This would make it possible to directly fasten the other end of the sensor 121 to the metal disk, so that the leaf spring 131 and its fastening could be economized As a further possibility a corresponding strip could be punched out and laterally bent from the disk edge 113, so as in this way to take the place of a leaf spring 131 and the complicated fastening thereof.

It is also conceivable for a rod regulator with a sensor tube or a stiff sensor to pass from the edge only a short distance above the centre of the radiant heater. There, through a metal part portion retaining the sensor and guided in from below it is possible both to fasten the sensor and also bring about an electrical contacting at the end thereof. It can then be guided in analogy to the flexible metal braids to a connecting member or the like and for this purpose the braids should be insulated. This construction can be implemented with a flexible wire as the sensor.

In place of a sensor wire 121, in the construction according to FIGS. 3 and 4 it is also possible to use a thicker wire, which may not be flexible. Spring means corresponding to the leaf spring 131 can also be used here for fastening to at least one end.

Within the scope of the invention it is possible to fix one sensor end directly to the connecting lug of a connecting member. This offers the advantage that no other fastening for said end is needed. When contacting a sensor end by means of or via the metal disk or its edge, it must be ensured that the sensor is insulated against the metal disk at its other end.

Through the two embodiments it is possible to establish that a fitting of a sensor, which in particular merely comprises a single straight conductor, is very easily possible and only two fastening points are needed. A further important advantage of these embodiments is that both connections and connecting leads are very readily possible through the use of the metal disk as a conductor. Through the fitting of one sensor end to the metal disk, a considerable constructional simplification can be obtained. This leads to lower assembly costs, and consequently overall costs and leads to less sources of error.

What is claimed is:

1. Electric radiant heater with an active sensor for detecting the position of a cooking vessel on a hotplate, for example a glass ceramic plate, said radiant heater being located in at least one heating zone and being connected to a control, said control comprising an inductive resonant circuit, said hotplate covering said radiant heater, and said sensor:

comprises electrically conductive material, is part of said inductive resonant circuit of said control, is located in the vicinity of said heating zone and at least partly covers said heating zone, wherein said sensor runs in a substantially linear manner and is constructed loopless.

2. Radiant heater according to claim 1, wherein said sensor only has one portion passing over said heating zone.

3. Radiant heater according to claim 2, wherein said sensor is in the form of a straight, electric conductor.

4. Radiant heater according to claim 1, wherein said sensor passes transversely over said heating zone or the radiant heater.

5. Radiant heater according to claim 1, wherein said radiant heater is located in a metal disk substantially carrying said radiant heater, said metal disk being constructed as a return conductor or a second connection for said sensor.

6. Radiant heater according to claim 5, wherein said sensor is electrically insulated at one end relative to said metal disk of said radiant heater, a first electrical connection leading directly to said sensor and a second electrical connection leading to said metal disk, which is in turn electrically connected to said sensor, said two electrical connections being connected to said control.

7. Radiant heater according to claim 1, wherein said sensor passes centrally over said heating area of said radiant heater.

8. Radiant heater according to claim 7, wherein said radiant heater has several heating areas and said sensor passes over all of said heating areas.

9. Radiant heater according to claim 1, wherein said sensor is fitted to said radiant heater in such a way that when said radiant heater is fitted to said hotplate, said sensor passes at a distance of 0.1 mm to 10 mm below said hotplate.

10. Radiant heater according to claim 1, wherein said sensor is rigid.

11. Radiant heater according to claim 10, wherein said sensor comprises an outwardly electrically insulated metal tube.

12. Radiant heater according to claim 11, wherein said sensor is combined with a conventionally used rod regulator with a metal outer tube in such a way that said metal outer tube of said rod regulator forms said sensor.

13. Radiant heater according to claim 12, wherein said rod regulator is usually fitted with a residual thermal contact to said radiant heater, said residual thermal contact of said rod regulator not being required and as a result thereof, space is made available in said rod regulator which is constructed as a connecting member for said sensor connection.

14. Radiant heater according to claim 1, wherein said sensor is constructed elastically or flexibly.

15. Radiant heater according to claim 14, wherein said sensor is stretched over at least a portion of said heating area and is constructed as one of the following group: a wire, a braid or metal band.

16. Radiant heater according to claim 1, wherein spring means are provided for compensating a thermally caused length change of said sensor or maintaining the tension of said sensor or mounting at least one end of said sensor, said spring tension being matched to the time or thermal expansion limit of said sensor and/or th cross-section of said sensor.

17. Radiant heater according to claim 16, wherein said spring means comprise a leaf spring.

18. Radiant heater according to claim 16, wherein said sensor is fastened by at least one end by said spring means to said radiant heater.

19. Radiant heater according to claim 18, wherein said spring means are electrically insulated against a metal disk in which said radiant heater is located.

20. Radiant heater according to claim 1, wherein the material of said sensor has no Curie point.

21. Cooking area with several of said electric radiant heaters, wherein at least one of said radiant heaters is constructed according to claim 1.

* * * * *